United States Patent [19]

Nicolai

[11] 3,970,096

[45] July 20, 1976

[54] TENT

[76] Inventor: William S. Nicolai, 3314 Wallingford Ave. N., Seattle, Wash. 98103

[22] Filed: Mar. 10, 1975

[21] Appl. No.: 556,776

[52] U.S. Cl. ..... 135/14 V; 135/4 R; 135/DIG. 1; 4/172.12; 135/15 PQ

[51] Int. Cl.[2] ..... A45F 1/10; A45F 1/12; A45F 1/16

[58] Field of Search..... 135/14 V, DIG. 1, 14 D, 135/1 R, 4 R, 5 R; 4/172.12

[56] References Cited

UNITED STATES PATENTS

| | | | |
|---|---|---|---|
| 659,981 | 10/1900 | McCall | 135/14 D |
| 758,033 | 4/1904 | Holmes | 135/14 V |
| 758,642 | 5/1904 | Gotsche | 135/3 R |
| 1,388,478 | 8/1921 | Nelson | 135/DIG. 1 |

FOREIGN PATENTS OR APPLICATIONS

| | | | |
|---|---|---|---|
| 1,071,561 | 3/1954 | France | 135/DIG. 1 |
| 1,183,642 | 12/1964 | Germany | 135/DIG. 1 |
| 291,755 | 6/1913 | Germany | 135/14 V |
| 28,061 | 12/1902 | United Kingdom | 135/14 V |

*Primary Examiner*—Werner H. Schroeder
*Assistant Examiner*—Conrad L. Berman

[57] ABSTRACT

The tent herein comprises outer nonporous and inner porous layers disposed in spaced relation to each other, with a continuous air passageway therebetween. Compression tent supporting means comprises a plurality of demountable, substantially, semicircular rods, preferably formed of fiber glass, forming arched rafters, and of a plurality of relatively short pieces slidably interconnected to form two rod units. These two rod units are interconnected by a sleeve, slidably mounted on one unit, to slidably receive the end portion of the other. The arched rafters are spaced apart and alined substantially parallel to each other and progressively decrease in diameter in a tent longitudinal direction. An inner tent layer is suspendedly supported by an outer layer by porous netting strips. At the end portions, nonporous, substantially semiannular shaped end members are provided which extend radially inwardly and angularly between the inner and outer tent layers. At the end portions, the outer tent layer is under tension by opposite, outwardly directed forces. All of the forces holding the tent in place are tension forces except forces acting through the tent rod units which are compression forces. All heat generated within the tent, such as that formed by human breathing or by the burning of a candle, rises upwardly in the tent and passes through the inner tent layer, thence longitudinally through the passageway between the inner and outer tent layers and thereafter out through the tent end portions by way of breather passageways disposed in end portions of the tent.

11 Claims, 18 Drawing Figures

TENT

BACKGROUND OF THE INVENTION

The present invention relates to a tent construction used primarily under mountain weather conditions, as an optimum shelter for persons, such as two, and which can be readily carried by a mountaineer in a backpack. Specifically, the invention tent sets very high, and sometimes new, standards of comfort, convenience, reliability, and lightness in mountaineering and hiking tents carried in a backpack.

The invention tent comprises an outer nonporous layer to eliminate penetration therethrough of rain and moisture. An inner porous layer is provided and disposed in spaced relation to the outer layer providing an air space between the two layers from 1 to 4 inches thick and which air space extends the full length of the tent. The ends of this air space are closed by semiannular shaped end members which extend radially inwardly and angularly from the outer tent layer to the inner porous tent layer. This air space chamber, between the inner and outer tent layers, functions to allow warm, moisture-laden air to rise from within the tent, through the inner porous tent layer and thence longitudinally through the air chamber and thence outwardly through vents in the semiannular end members. Air so leaving the tent is displaced by fresh air drawn from the floor level of the tent, passing around the occupants in the tent, warmed thereby and by possible burning candles in the tent, thence through the inner tent layer, thence through the enclosed air space chamber, and thence out the end portions of the tent. Thus, a chimneylike action takes place and an air circulation in the tent, which promotes an efficient air flow and thus maintains a low, as possible, humidity level in the tent. The insulation value, resulting from the air circulation promoted by the heat of human bodies and at times augmented by burning candles in the tent, is of substantial significance in that minimum temperatures within my tent often show a temperature increase in excess of 10°F. over temperatures existing outside my tent.

Compression support means for the tent comprise a plurality of arched rafters in the form of demountable, substantially, semicircular rods which are preferably formed of fiber glass and which rods are formed of a plurality of relatively short pieces slidably interconnected to form two rod units. These two rod units are interconnected by a sleeve slidably mounted on one unit and which sleeve slidably receives an end portion of another unit. The plurality of substantially semicircular rods are spaced apart and alined substantially parallel to each other and the semicircular rod units progressively decrease in diameter in a longitudinal direction of the tent from the entrance end portion of the tent to the other end portion thereof. The inner tent layer is suspendedly supported by the outer tent layer by strips of porous netting material which do not interfere with air circulation through the air chamber between the inner and and outer tent layers.

At the end portions of the tent, the outer tent layer is under tension by forces at each end thereof, each of which is directed in an opposite and outward direction. All of the forces holding the tent in place are tension forces except the compression forces which act through the tent rod units. All of the heat that is generated in the tent is generated by the human occupants thereof or by the burning of a candle or the like.

By having the tent taper from a door end thereof, both in height and width and with only sufficient space for two persons and gear to be stashed away, minimum air space obtains, so that human body heat and heat from candles are involved in a limited space so that such heat factors will be effective. Additional guy lines are provided to take care of side pressures resulting from wind blowing in a direction transverse of the longitudinal axis of the tent.

SUMMARY OF THE INVENTION

In a summary way, the present invention contemplates an outer nonporous layer, a spaced inner porous layer, a tent floor, and substantially semiannular shaped end members, which extend radially inwardly and angularly between the tent layers. A plurality of arched rafters in the form of demountable half circular hoops of diameters decreasing in size from the front to the rear of the tent provide compression support for the tent. These hoops are made of rather small sections which can be readily joined together to form relatively large semicircular hoops so that when the hoops are disassembled the parts take up a minimum of space. The space between the tent layers provides an air passage and air which has a temperature somewhat increased by the occupants of the tent and possibly by lit candles therein, rises in the tent, passes through the inner porous tent layer, passes lengthwise of the air passageway between the tent layers and thence out vents or louvers provided in the semiannular end members. The hoops provide a support for compression forces utilized in supporting the tent and all other support for the tent is in the nature of tension forces which are disposed in opposite directions at opposite ends and sides of the tent.

The features, advantages, and objects of my invention which are explicit and implicit in the foregoing will become apparent and more fully understood from the following detailed description of the invention made in connection with the accompanying drawings.

DETAILED DESCRIPTION OF THE DRAWINGS

Figure 1:
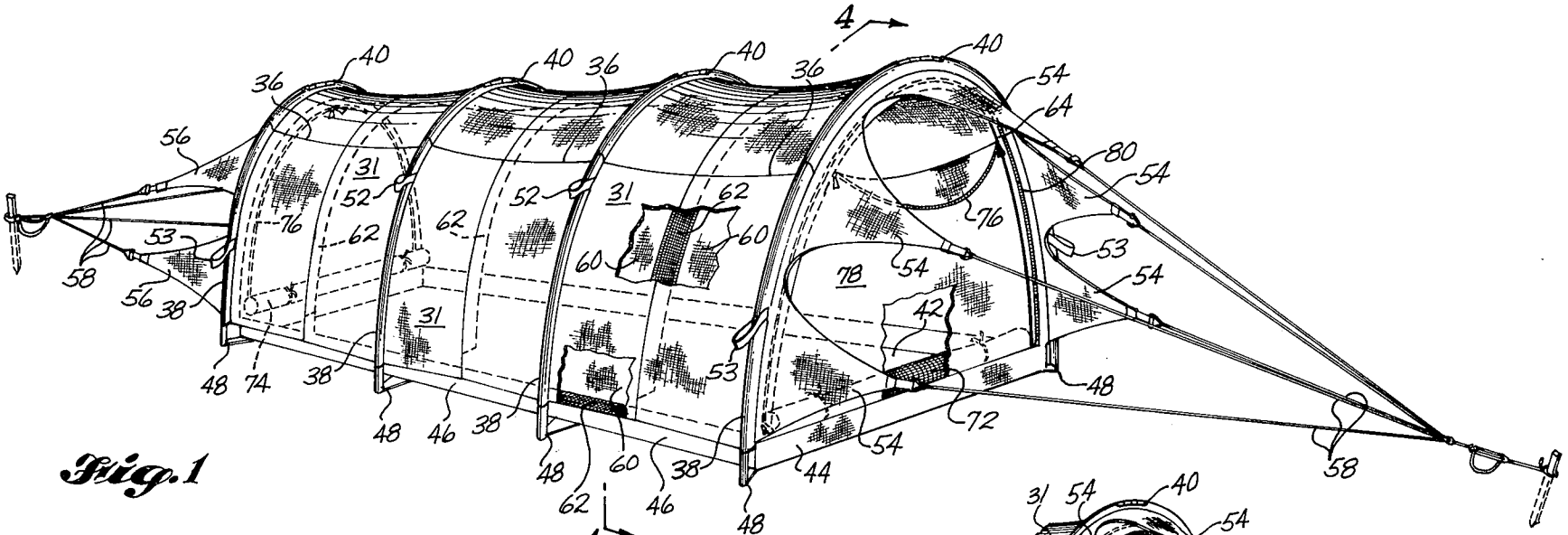
FIG. 1 is a perspective view of an embodiment of my invention.

Referring to FIGs. 12 to 18 of the drawings, the preferred form of rods 19 employed in my invention are shown. Tubular sections 20 of rods 19 are of a length for convenient packing and an elastic cord 22 is threaded throughout the length of a plurality of sections 20, such as six or eight thereof. Knots 24 are disposed at the ends of the elastic cord 22. The tubular sections 20 are composed of a light, substantially rigid, weather resistant material, such as fiberglass. The elastic cord 22 is formed of weather and abrasive resistant material, such as a rubber core covered with a woven nylon sheath. A weather resistant metal coupling 26 has one end portion fixedly connected with a tubular section 20 and slidably connected with the next adjacent tubular section 20. At the center connection, one abutting tubular section 20 is permanently covered with a weather resistant metal tube 28, having a shoulder 29 thereon, and a coupling sleeve 30 slidably moves in one direction to couple the center tubular sections 20 together or to release them from each other, the shoulder 29 arresting motion of the sleeve 30 in one direction. The structure shown provides for a rod 19 which may be arced, as shown detached in FIG. 13, (after being formed into a continuous rod) and with diameters of the semicircular rods formed thereby, as used in my tent, having diameters in the range of approximately 3 to 7 to form arched rafters. The rod 19 just described will be later related to the pockets provided in the tent structure in which said rod is used in my invention.

Figure 8:
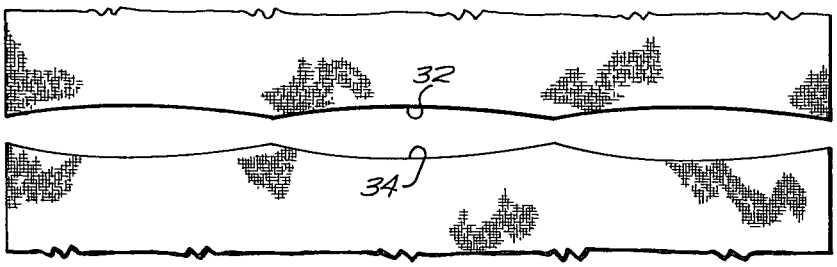
FIG. 8 is a fragmentary view showing a manner of sewing pieces of material together to form an outer tent layer of my invention.

The outer tent layer 31 is fabricated from nonporous material, such as a nylon fabric treated to prevent rain and water penetration therethrough. The material is cut in accordance with the pattern shown in FIG. 8 of the drawings and the edges 32 and 34 sewn together to form seams 36 of FIG. 1. Thus, the said seams 36 (juncture between edges 32 and 34) extend longitudinally of the final tent as indicated in FIG. 1 of the drawings. There are, preferably, two seams 36 and three longitudinally extending panels to form the outer, nonporous tent layer 31. One of the seams 36 is shown in FIG. 1 of the drawings and the other seam will be symmetrically disposed in the corresponding portion of the side of the tent which is in the background in FIG. 1 of the drawings. By such cutting and sewing of material, the surface of the final outer tent layer 31, when stretched to final position, compriises a plurality of pieces of material joined at a plurality of concave edge portions and which, when under tension, lie in a saddle shaped contour.

Rod-receiving pockets 38 are disposed in the outer tent layer at the outer periphery thereof. These pockets 38 are formed by first forming a loop in the material and then stitching the material together adjacent the edges of the loop to form such a loop and retain the same. The pockets 38 are of a size to slidably receive the rods 19. An opening 40 is provided at the top of each pocket 38 so that a rod 19 can be inserted in each pocket with the outer end portion of the rods being inserted simultaneously into opposite side portions of the same pocket.

Figure 2:
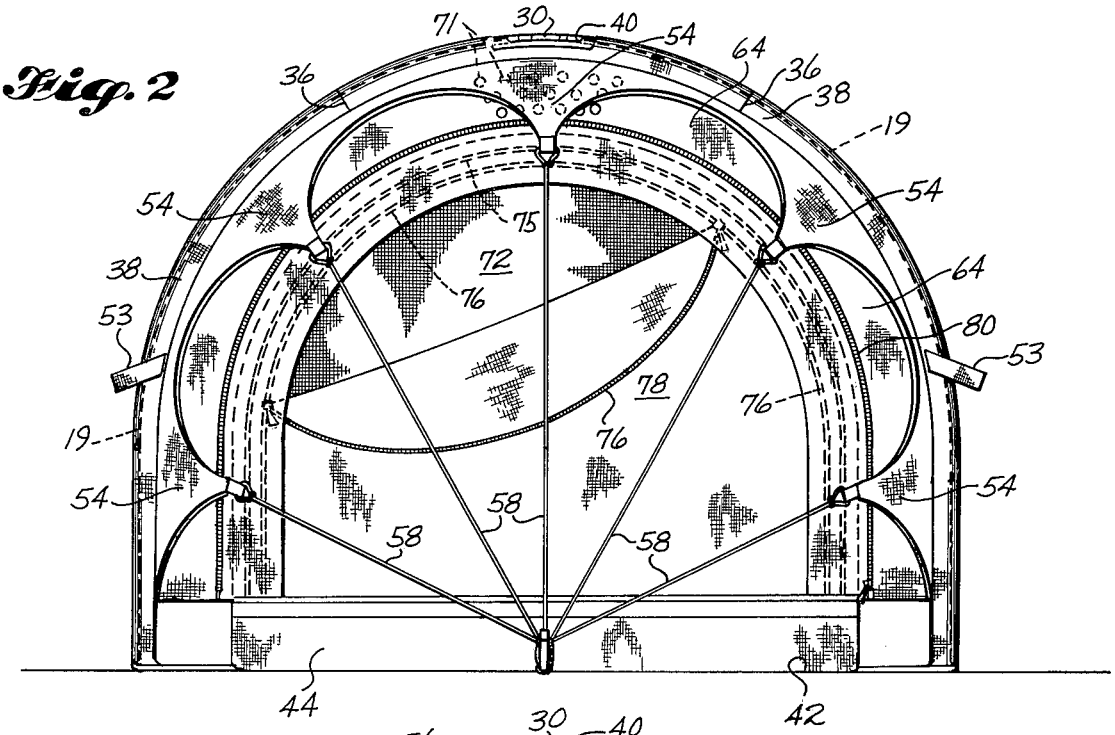
FIG. 2 is a front elevational view of the structure of FIG. 1.
Figure 3:
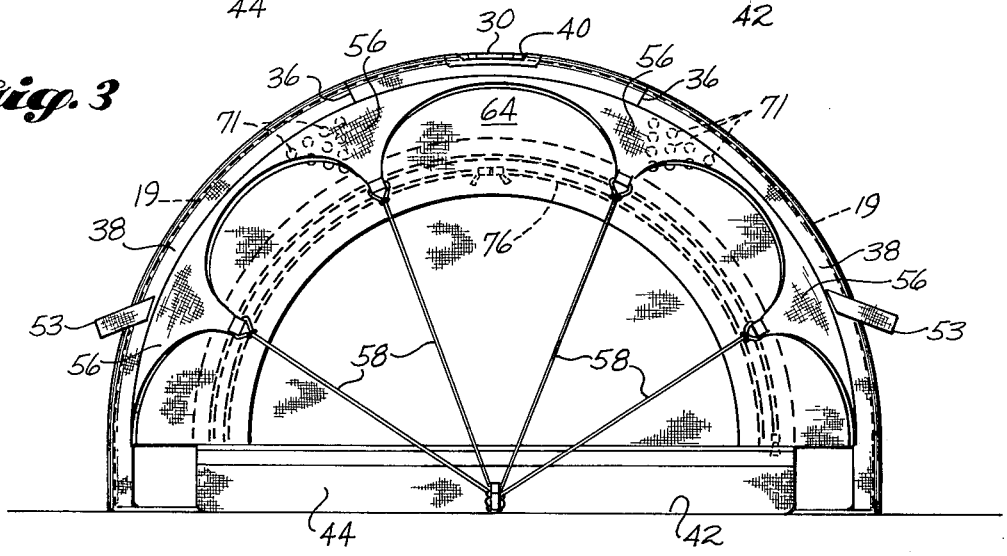
FIG. 3 is a rear elevational view.
Figure 4:
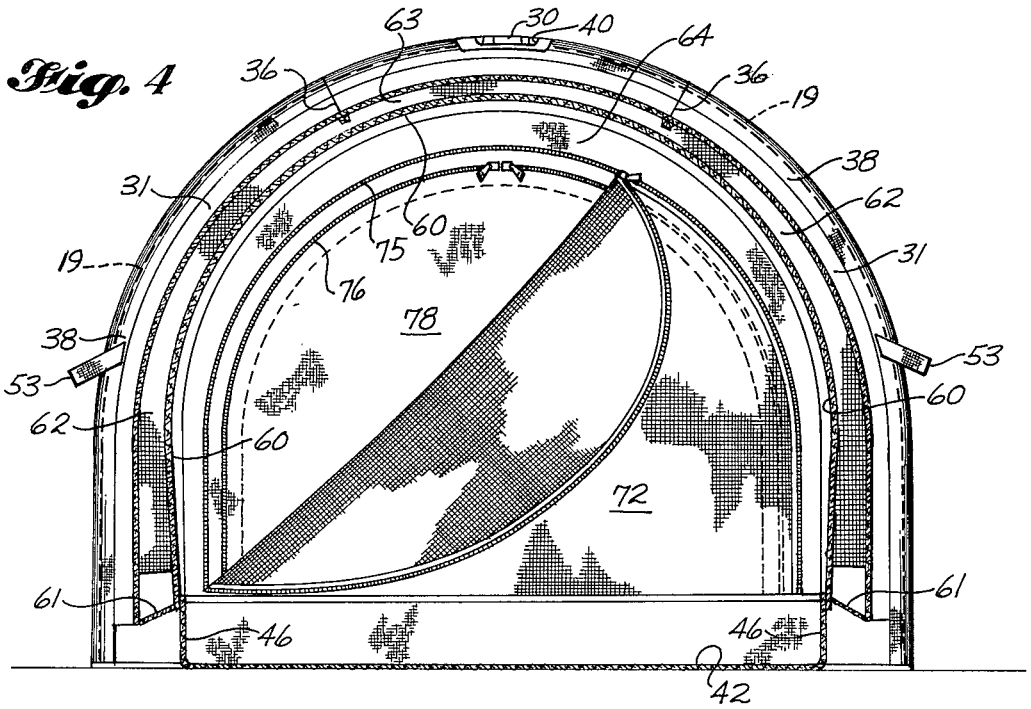
FIG. 4 is a sectional view taken substantially on broken line 4—4 of FIG. 1.
Figures 7, 12, 13, 14, 15, 16, 17, 18:
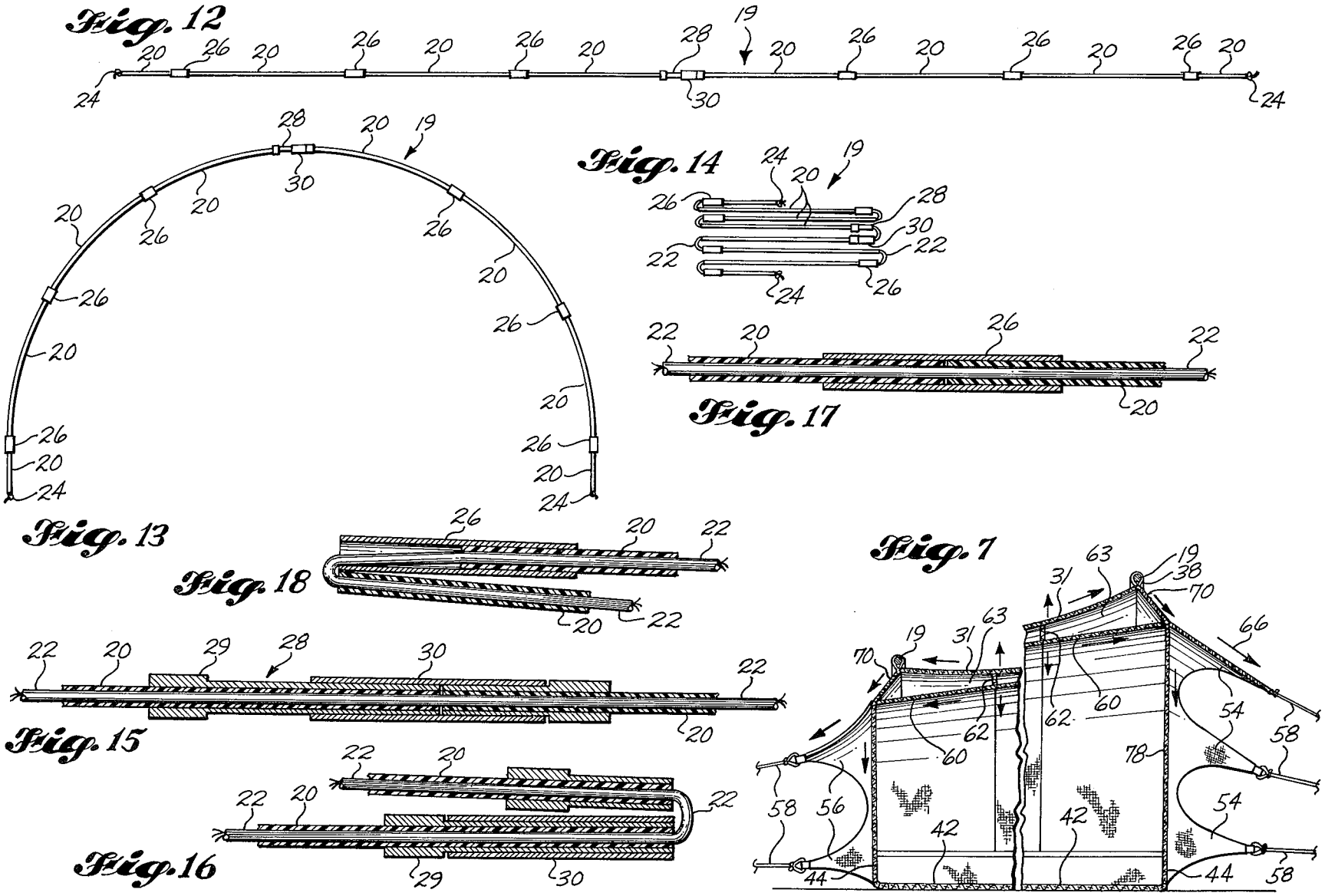
FIG. 7 is a view similar to FIG. 5, with parts broken away, of a modified form of my invention.
FIG. 12 is a view showing one of the rods used in my invention in assembled and elongated position.
FIG. 13 is a view of the rod structure of FIG. 12 in arced position.
FIG. 14 shows the structure of FIG. 12, with the tubular sections of the rod in collapsed position for storage.
FIG. 15 is a fragmentary view, on a larger scale, illustrating the center juncture of the rod structure of FIG. 12, when in extended position.
FIG. 16 is a view of the structure of FIG. 15 but with the tubular sections of the rod collapsed and in a position for storage.
FIG. 17 is a fragmentary view, on a larger scale, showing the joint between other tubular sections of the rod in assembled position.
FIG. 18 is a view of the structure of FIG. 17 but with the tubular sections of the rod collapsed and in a position for storage.

A floor 42 has upturned end portions 44 (FIGs. 1, 2 and 3) and upturned side portions 46 (FIGS. 1 and 4). The material employed in forming floor 42 is a fabric treated to withstand weather and moisture conditions prevailing at ground level in all types of weather, such as nylon fabric treated to prevent rain and weather penetration and particularly at ground level. The said upturned end portions 44 and upturned side portions 46 are connected with the outer tent layer 31 through rod pocket feet 48. Through this construction, the upturned longitudinally extending side edge portions 46 and upturned crosswise extending portions 44 are formed of a material suitable for close position to the ground. Thus, when a flexible rod of the type illustrated in FIG. 12 is inserted in each of the rod-receiving pockets 38, the said rods will assume a substantially semicircular shape (of FIG. 13) and the rods disposed in the four pockets illustrated in FIG. 1 will illustrate a plurality of spaced, substantially, semicircular rods disposed in, substantially, parallel, spaced relation to each other and symmetrically disposed about a common longitudinal axis.

Some of the pockets 38, as the centrally disposed ones, carry guy line loops 52 at an upper elevation thereon. The end pockets 38 also carry guy line loops, as loops 53, and preferably at a lower elevation. Thus, the central and end portions, of the tent, at opposite sides, can be secured by guy lines to the ground to counter sidewise movement of the tent in response to wind pressures. Also, any tendency of the tent to lift, in response to air being compressed below the tent floor 42, is resisted by the said guy lines secured to the tent guy loops 52 and 53.

Tension flaps 54 and 56 may be a continuation of the outer tent layer 31 and are disposed, respectively, at the front and rear ends of the tent. Suitable guy lines 58 are connected with said flaps 54 and 56, and tension is exerted in opposite directions on said guy lines 58. Thus, at this stage of the description, the rods 19, comprising tubular sections 20, are held in a semicircular position by the outer tent layer 31 and floor 42 and associate parts. Such rods 19 provide a compression resisting member to support the tent against such forces. The guy lines 58 provide tension in opposite directions endwise of the tent to resist tension forces in such direction and sidewise tension is provided on the tent through the guy lines (not shown) connected with the guy line loops 52, 53. As the guy lines described, all extend angularly outwardly and downwardly from the tent, such guy lines also resist any pressure tending to lift the tent off the ground.

The porous inner tent layer 60 is suspendedly supported by the outer tent layer 31 and may be a layer provided by an uncoated nylon fabric. Mesh netting strips 62 (see FIGS. 1 and 4) extend radially inwardly from the outer tent layer 31 and are of an open mesh, eliminating any air flow impedance in the passageway 63 between layers 31 and 60. The inner ends of strips 62 connect with the inner tent layer 60 and such strips 62 support the inner tent layer at such area. At the bottoms of passageways 63 (see FIG. 4) snow baffle strips 61 connect between the outer tent layer 31 and the inner tent layer 60. These baffle strips 61 angle downwardly and outwardly and the stitching seams between them and the outer tent layer 31 are intermittent so that any ice which may be formed in passageway 63 may be removed by shaking the tent layers to loosen the ice and then allowing the ice to fall and exit through the breaks in the sewing seam line provided by the intermittent sewing. The snow baffle strip 61 deters snow from being blown upward and into passageway 63. Substantially semiannular shaped end members 64 are disposed at each end of the tent. The forces of parts suspending the inner tent layer 60 from the outer tent layer 31 are illustrated in the force disagram of FIG. 5. The tension forces exerted by the guy lines 58 in opposite directions longitudinally of the tent are illustrated by arrows 66. The compression forces on the semicircular rods 19 (including rod sections 20) are illustrated by the arrows 68. The end members 64 are of such a shape and location that they become taut and support the outer tent layer 31 and the inner tent layer 60 in such taut position because of the various forces involved and particularly the forces as indicated by the arrows 66 and 68.

The end members 64 (see also FIG. 1) are disposed generally radially and also angularly inwardly, longitudinally considered of the tent. The forces in the direction of the arrows 66 represent the force involved in guy lines 58, tension flaps 54 and 56 and the outer and inner tent layers 31 and 60. The forces resisted by the tubular rods 19 are represented by arrow line 68. Thus, all forces involved in maintaining the tent erect are tension forces except the forces involved in connection with the load carried by rods 19.

As an alternate construction of semiannular end members 64, which extend, in part, inwardly longitudinally considered of the text, I may employ semiannular end members 70 (see FIG. 7) which extend, in part, outwardly longitudinally considered of the tent. Such members 70 extend generally radially as do the members 64. The remaining force lines and parts in connection with FIG. 7 may be the same as those of FIG. 5 and hence, are given the same numbers and the description thereof is incorporated by reference and without repetition of description.

In operation, relatively warmer and moisture laden air rises in the tent and passes through inner tent layer 60 and travels lengthwise of passageway 63 and normally toward the end members 64 or 70 at the front end portion of the tent and thence out breather openings 71 in said end members. Wind conditions may cause venting of air from passageway 63 out breather openings 71 in the end members 64 or 70 at the rear end of the tent. In any event, heat generated in the tent (as by human breathing or by the burning of a candle) causes air to rise upwardly in the tent, pass through the porous inner tent layer 60, thence longitudinally in the passageway 63 (between inner layer 60 and outer layer 31), and thence exiting through breather openings 71 in the end members 64 or 70.

Preferably, mosquito nettings 72 and 74 are employed at the front and rear door opening of the tent and they are shown as being rolled up and out of the way in FIG. 1 of the drawings. Zipper means 75 detachably secures each of the mosquito nettings to a semicircular end member 64 and one-half of such zipper means is shown by the dotted lines 75 in FIG. 2 of the drawings.

In FIG. 1, a front door 78 is detachably secured to one of the semiannular end members 64 and preferably by means of a zipper 76, part of which is carried by an end member 64 and the other part of which is carried by the front door 78 (FIG. 1). The rear door is a counterpart of the front door and is secured to the rear end member 64 and by a zipper, which is also numbered 76. Thus, the mosquito nettings can be zipped in place or unzipped and rolled out of the way, all of which is illustrated in FIG. 1 of the drawings. Also, either the front door or the rear door may be secured wholely in place as a closed door or can be opened to any desired degree, such as being partially opened as illustrated in FIG. 1 of the drawings.

Figure 10:
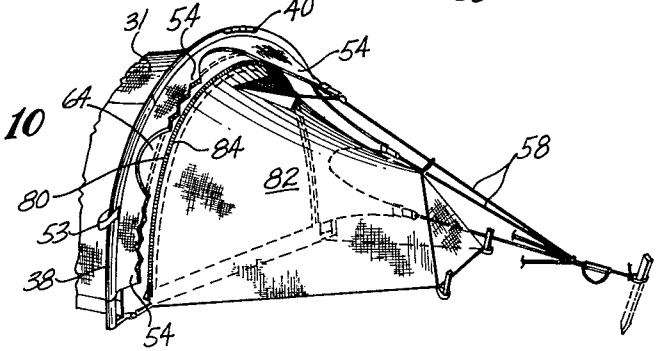
FIG. 10 is an enlarged fragmentary view of structure shown in FIG. 9.

Preferably, the semiannular end member 64 at the front end of the tent (see FIG. 10) also carried one-half of a zipper 80 and a mating half 84 of a zipper is carried by a waterproof tent layer 82 providing an optional vestibule disposed at the front door area of a tent and disposed under tension flaps 54 and guy lines 58.

Figure 11:
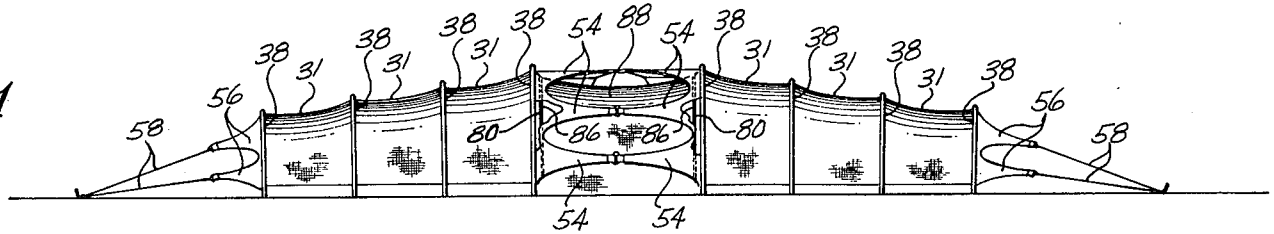
FIG. 11 is a view showing two tents of my invention arranged with the head portions abutting and a vestibule arranged in such area.

Also, two tents may be arranged with their front door portions adjacent as illustrated in FIG. 11 of the drawings. Each of the tents at the front door area has its semiannular end member 64 provided with the zipper portion 80 which was previously described for use in connection with the vestibule of FIG. 10. This same zipper portion 80 disposed at the front end portions of two tents disposed in the positions illustrated in FIG. 11 of the drawings may be employed in connection with zipper portions which are mated with zipper portions 80. These zipper portions 86 are carried by both ends of a waterproofed tent layer 88 so that the area between the front end portions of two tents abutting, as illustrated in FIG. 11 of the drawings, may be a covered, joining area between the front end portions of two tents.

Figure 9:
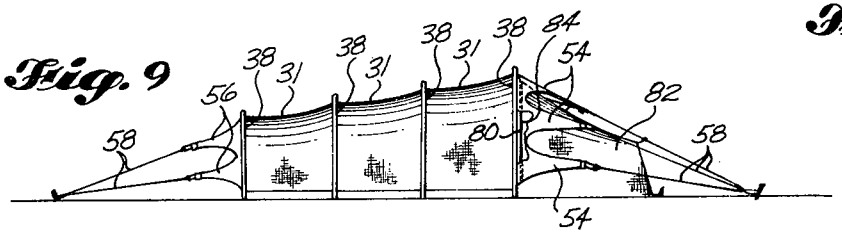
FIG. 9 is a view, on a smaller scale, showing a vestibule added at the front end portion of a tent of my invention.

The area under the tent layer 88 of FIG. 11 or that under the tent layer 82 of FIG. 9 may be used as a cooking area or as a storage area and when used as a cooking area, suitable vents through the tent layer will be provided for the emitting gases.

In the construction of FIG. 9 of the drawings, a vestibule employing tent layer 82 was shown and described. Such a vestibule further provides for isolating the front door 78 and its environs from the weather. Where extremely severe weather conditions obtain and the vestibule is employed for such reason, then a tunnel entrance of conventional design may be used at the rear door area of the tent. The size and proportions of the parts of this tent at such area are very suitably endowed for the utilizing of a tunnel entrance to the tent at such area.

SUMMARY

From the foregoing, it will now be obvious that I have provided a tent comprising a plurality of arched rafters in the form of substantially, semicircular rods 19 disposed in substantially, parallel, spaced relation to each other and symmetrically disposed about the common longitudinal axis of a tent. An outer, nonporous tent layer 31 is supported by the rods 19 disposed in semicircular positions. The rods 19 are of knock-down construction and can be assembled into continuous rods as indicated in connection with FIGS. 12 to 18 of the drawings and the rods are inserted in place in the outer tent layer 31 through openings 40. Next, a porous inner tent layer 60 is provided and this inner tent layer 60 is supendedly supported from the outer tent layer 31 and with the inner tent layer 60 positioned relatively close to the outer tent layer and providing an air passageway between the tent layers. At the ends of the passageways and as a part of the means for supporting the inner tent layer 60 from the outer tent layer 31, I have provided nonporous, substantially semiannular shaped end members shown in FIG. 5 as members 64 or their alternates which are shown in FIG. 7, namely, semiannular end members 70. These end members 64 or 70 extend radially and angularly between the outer tent layer 31 and the inner tent layer 60. In one instance (FIG. 5), the members 64 extend inward angularly while in FIG. 7, the same extend outwardly (inwardly and outwardly both being considered in the longitudinal direction of the tent). The members 64 and 70 are provided with breather openings 71. The means for holding the lower end portions of the end members 64 or 70 downwardly constitutes the side portions of the tent and means to hold the same to the ground. Then I provide tensioning means operating in opposite directions which will include the tension flaps 54 and 56 on the opposite end portions of the tent and the guy lines 58 connected with the tension flaps 54 and 56.

Figure 5:
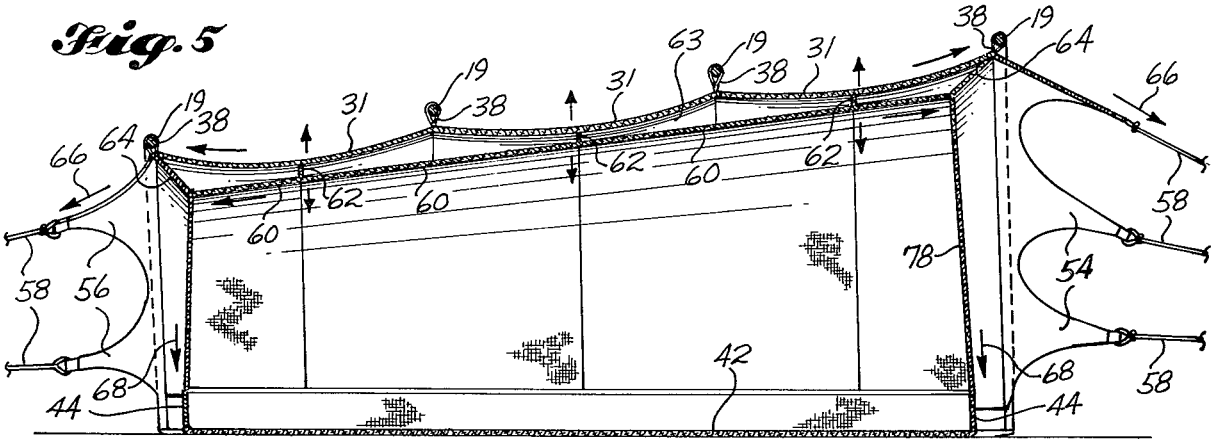
FIG. 5 is a somewhat schematic elevational view illustrating forces involved in support of my tent.
Figure 6:
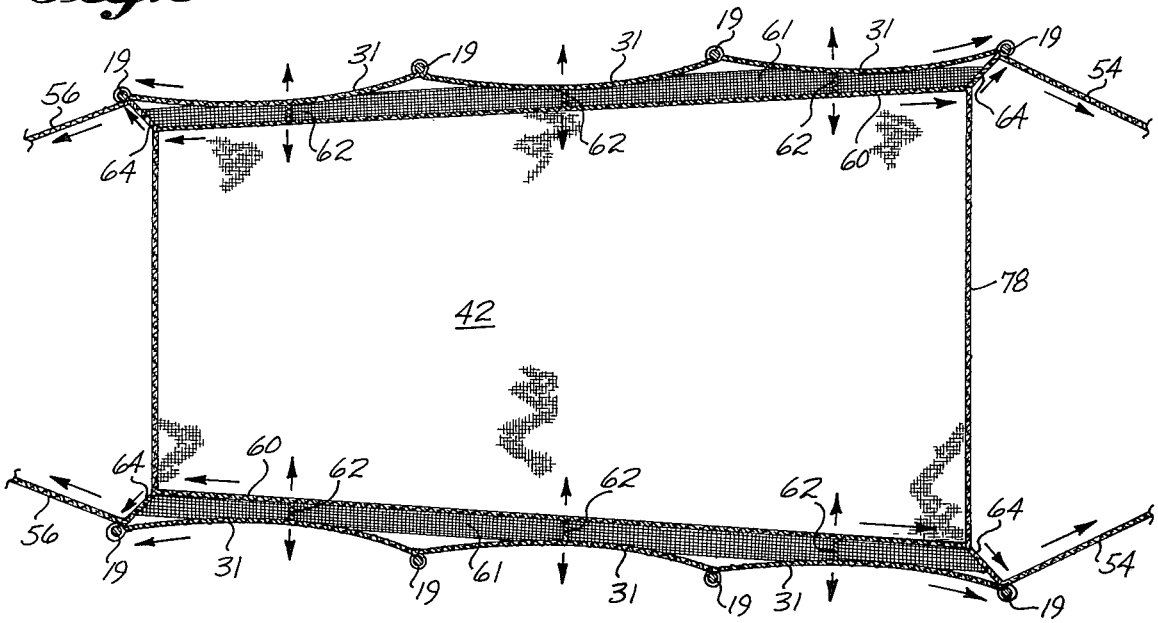
FIG. 6 is a sectional view of the structure of FIG. 5, taken just above the floor level therein.

Preferably, the layers of the outer tent layer 31 comprise a plurality of concave edge portions 32 and 34 (see FIG. 8) which are joined together along the concave edge portions and which when under tension lie in the saddle-shaped contour of the tent shown in FIGS. 1 and 5 and 6 of the drawings.

Preferably, the rods 19 which support the tent at spaced intervals are of progressively decreasing diameters so that the outer tent layer in the final tent has a tapered semicircular contour.

Preferably, the means for suspendedly supporting the inner tent layer 60 from the outer tent layer 31 includes mesh netting strips 62 to thus eliminate interference in the air passageway 63 between the outer tent layer 31 and the porous inner tent layer 60.

Also, preferably, the tension means at the end portions of the tent include tension flaps 54 and 56 which are an extension of the outer tent layer 31. These tension flaps 54 and 56 are preferably substantially triangular in shape and that the minimum number thereof on either end of the tent is four and at the front end of the tent such flaps may be five in number.

The semicircular rods 19 are formed of a resilient spring material and when secured may form semicircular configurations. The floor of the tent is provided as the securing means between the feet or lower end portions of the semicircular rods and thus when the rods are used to support the load, the rods are under tension and such tension is preserved through the use of the floor connecting between the feet end portions of the semicircular rod sections.

In order to provide a knock-down tent of a very compact size, preferably the rods 14 are formed of a plurality of interconnected pieces secured together by detachable connector means, such as the couplings 26, slide couplings 30, sleeves 28, and elastic cords 22. A coupling 26 is mounted on the end portion of one rod and is mounted for sliding reception on an adjacent end portion of a contiguous rod end portion. Slide couplings 30 are slidable on metal tubes 28 and detachably interconnect a two-piece rod 19 at the center thereof. A preferred material for forming the tubular sections 20 is hollow fiber glass.

Preferably, guy line loops 52 and 53 are carried by opposite sides of the tent to be connected by guy lines to counter the pressure of winds tending to move the outer tent sidewise and off the ground.

Also, the doors of this tent are preferably one-half a disc such as the shape of front door 78. The doors of this tent are connected by a zipper slide fastener.

A nonporous tent layer 82 is connected with one of the substantially semiannular end shaped members 64 or 70 and the tent layer 82 of the vestibule extends radially and longituginally and under the tension means comprising the tension flaps 54 at the head end of the tent or 56 at the back or rear end portion of the tent and under the guy lines 58 disposed at either the front or rear portion of the tent. This vestibule tent layer 82 is preferably connected by zipper means with the semiannular end members 64 or 70.

Obviously, changes may be made in the forms, dimensions, and arrangements of the parts of my invention without departing from the principles thereof, the above setting forth only preferred forms of embodiment.

I claim:

1. A tent comprising a plurality of spaced, arched rafters disposed in substantially, parallel, spaced relation to each other and symmetrically disposed about a common longitudinal axis; an outer, nonporous tent layer supported by said rafters and forming a substantially semicylindrical outer tent layer; a porous inner tent layer; means suspendedly supporting said inner tent layer, connected to said outer tent layer, supporting said inner layer relatively close to and in spaced relation to said outer tent layer, and providing an air passage between said tent layers; nonporous, substantially semiannular shaped, end members, extending radially and angularly between the outer and inner tent layers; means holding the lower end portions of said end members downwardly and spacing the inner tent layer from the outer tent layer; and tensioning means connected to the opposite end portions of said outer tent layer permitting forces directed in opposite directions to be, respectively, connected therewith to tension the end portions of the outer tent layer longitudinally and in opposite directions.

2. The combination of claim 1, wherein said end members, in extending angularly, also extend inwardly of the longitudinal direction of the tent.

3. The combination of claim 1, wherein said end members, in extending angularly, also extend outwardly of the longitudinal direction of the tent.

4. The combination of claim 1, wherein said outer tent layer comprises a plurality of pieces of material joined at a plurality of concave edge portions and which, when under tension, lie in a saddle-shaped contour.

5. The combination of claim 1, wherein the means suspendedly supporting said inner tent layer comprises depending mesh netting strips disposed between tent layers and extending parallel to the arched rafters.

6. The combination of claim 1, wherein said arched rafters are flexible tubes of spring material tending to return to a linear configuration, a floor is provided in said tent and connected with the outer tent layer and the foot end portions of the tubes are connected with said floor and the floor is tensioned by said tubes.

7. The combination of claim 6, wherein said arched rafters are formed of a plurality of pieces interconnected by detachable connector means in the form of a sleeve slidably mounted on an end portion of one tube and mounted for sliding reception on an adjacent end portion of a contiguous tube end portion of another tube and cord connecting means centrally disposed and connected at opposite ends of said tubes, retaining said detachable connector means in connecting relation.

8. The combination of claim 6, wherein said arched rafters are rods formed of hollow fiberglass.

9. The combination of claim 1, wherein the tensioning means comprises a plurality of triangular extensions of said outer tent layer extending therefrom and in spaced relation to each other and with the number thereof being at least four.

10. The combination of claim 9, wherein a detachable, nonporous tent layer connects with one of said substantially semiannular shaped end members, and extends radially and longitudinally and under the said tensioning means comprising extensions of said outer tent layer to provide a tent vestibule at an end portion of the tent.

11. The combination of claim 10, wherein the nonporous tent layer is connected by a zipper slide fastener to said substantially semiannular shaped end member.

* * * * *